United States Patent [19]

Kohama et al.

[11] Patent Number: 4,895,489

[45] Date of Patent: Jan. 23, 1990

[54] AXIAL FLOW FAN

[76] Inventors: Yasuaki Kohama, Katahira 2-1-1; Hideo Hirama, 30-1 Nishitaga 5-chome; Takuzo Kanno, 30-1, Nishitaga 5-chome; Takashi Ishida, 30-1, Nishitaga 5-chome, all of Sendai, Miyagi, Japan

[21] Appl. No.: 111,774

[22] Filed: Oct. 22, 1987

[30] Foreign Application Priority Data

Nov. 14, 1986 [JP] Japan ..... 61-271424

[51] Int. Cl.[4] ..... F04D 19/00

[52] U.S. Cl. ..... 415/218.1; 415/222

[58] Field of Search ..... 417/354, 423 T, 423 C; 415/213 C, 215, 212 A, 172 A, DIG. 1, 218.1, 220, 222

[56] References Cited

U.S. PATENT DOCUMENTS

| | | | |
|---|---|---|---|
| 2,397,171 | 3/1946 | Troller et al. | 415/213 C X |
| 2,536,130 | 1/1951 | Herrman | 415/213 C |
| 2,698,128 | 12/1954 | Ault et al. | 417/423 T X |
| 3,118,594 | 1/1964 | Helmbold | 415/DIG. 1 |
| 3,146,007 | 8/1964 | Boivie et al. | 415/213 C |
| 3,531,221 | 9/1970 | Herberg et al. | 417/354 |
| 3,620,640 | 11/1971 | Soulez-Lauiviere | 415/DIG. 1 |
| 3,700,358 | 10/1972 | Papst et al. | 417/354 |
| 4,189,281 | 2/1980 | Katagiri et al. | 415/213 C |
| 4,189,281 | 2/1980 | Katagiri et al. | 415/213 C |
| 4,565,491 | 1/1986 | Ivanou et al. | 415/213 C |

FOREIGN PATENT DOCUMENTS

| | | | |
|---|---|---|---|
| 2607384 | 8/1977 | Fed. Rep. of Germany | 415/215 |

*Primary Examiner*—Louis J. Casaregola

*Attorney, Agent, or Firm*—Bruce L. Adams; Van C. Wilks

[57] ABSTRACT

An axial flow fan has a casing having an air flow passage therein which terminates at one end in an air inlet port and at the other end in an air outlet port. A hub carrying fan blades is rotatably disposed within the casing and rotationally driven by a motor contained interiorly of the hub. A set of stays support the motor and hub on the casing. Projections are provided on the casing and/or hub in the region of the outlet port to effectively divide air swirls which tend to form at the outlet port into smaller size swirls thereby reducing energy losses and improving efficiency.

6 Claims, 2 Drawing Sheets

AXIAL FLOW FAN

BACKGROUND OF THE INVENTION (a) Field of the Invention

This invention relates to novel designs of an axial flow fan, more specifically novel designs of the casing and hub of an axial flow fan. The casing and hub of an axial flow fan according to this invention are provided with cross-sectional inside surface configurations in the form of a circle or an ellipse and at leat one projection is provided in the air flow passageway inside the casing. The projections are provided on the hub or on the casing in order to break up efficiency-reducing large air swirls generally produced in the areas around the outlet port of the casing and at the rear end of the hub. It is also possible to provide projections both on the hub and casing.

(b) Prior Arts

Conventionally, an axial flow fan is provided with a casing enclosing a fan wheel having a diameter which first decreases in the air flow direction from the inlet port to a constricted "necked-down" portion, and increases again from this necked-down portion toward the outlet port as shown in FIG. 2, such as disclosed in U.S. Pat. No. 4,221,546. Another type of prior art axial fan has a cylindrical configuration in the axial central plane of the casing as shown in FIG. 3. In both of the above cases, there are no projections provided in the air flow passageway at the area around the outlet port. Because of this feature, the air flows through the air duct of the casing having a rather complicated inside surface configuration. Further, large air swirls are generated in the area around the outlet port because the cylindrical shape which serves to guide the air flow abruptly ends there. Still further, large swirls of air are also generated at the rear end of the hub because the cylindrical shape abruptly ends there. The abovementioned complicated air flows and swirls reduce the efficiency of the axial flow fans.

SUMMARY OF THE INVENTION

The object of the present invention is, therefore to provide an axial flow fan having a cross-sectional internal surface configulation of the casing and cross sectional external surface configuration of the hub in the shape of a circle or n ellipse in order to smooth out the air flow inside the casing, and to provide at least one projection in the area around the outlet port inside the casing in order to reduce detrimental effects of the large air swirls. If there is no projection provided at the end portion of the outlet port and the hub, large swirls causing energy loss are generated. However, according to the present invention, such swirls are divided by the projection into smaller size swirls so that the energy loss is kept small.

The axial flow fan according to the present invention has a cylindrical bore provided in a casing. One end of the bore is arranged to be an air inlet port through which air is drawn in, and the other end is arranged to be an air outlet through which air is expelled. At least one projection is provided at the end portion of the outlet port of the casing. The inside diameter of the casing is at its maximum at the inlet port, and is reduced toward the outlet port with the minimum diameter being at the outlet port. The hub is formed of a shape in which the diameter increases from the inlet port side toward the outlet port, and the diameter is at its maximum at a point closest to the outlet port.

PREFERRED EMBODIMENT OF THE INVENTION

Figure 1:
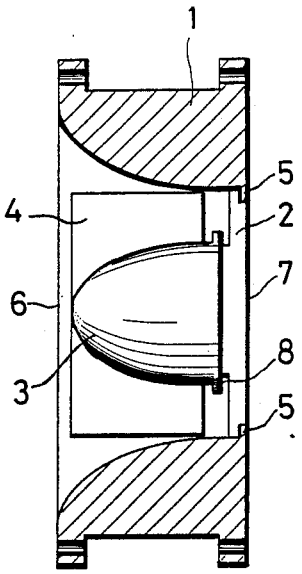
FIG. 1 is a cross-sectional view illustrating an axial flow fan according to the present invention.
Figure 2:
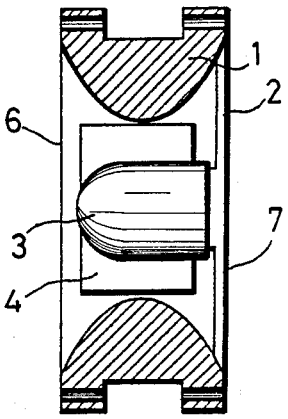
FIG. 2 PRIOR ART
FIG. 2 is a cross-sectional view illustrating a prior art axial flow fan.
Figure 3:
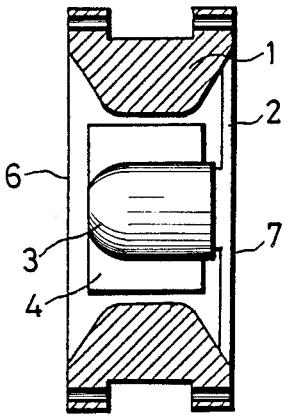
FIG. 3 PRIOR ART
FIG. 3 is a cross-sectional view illustrating another prior art axial flow fan.

The axial flow fan according to the present invention comprises, as shown in FIG. 1, a rotor consisting of a hub 3 provided with a plurality of fan blades 4, a motor which rotates the rotor with respect to the rotor shaft, a set of stays 2 which supports the motor, and a case or casing 1 which accommodates therein the rotor and motor.

Figure 4:
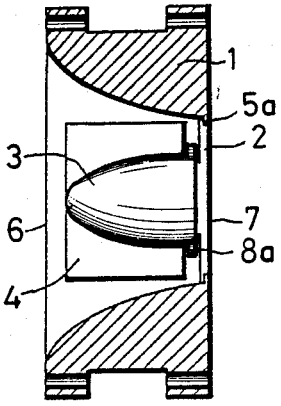
FIG. 4 is a cross-sectional view illustrating an embodiment of projections according to the present invention.
Figure 5:
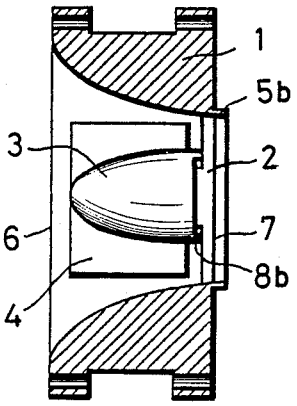
FIG. 5 is a cross-sectional view illustrating another embodiment of projections.

Air is drawn in by the fan blades 4 through an inlet port 6 when the rotor is rotated by the motor, and the air is passed to an outlet port 7 through the space or air flow passageway formed between the case 1 and the hub 3. The air that has passed the fan blades 4 then hits a projection 5 annularly extended around the circumferential end portion of the outlet port 7 and an annular projection 8 at the rear end of the hub 3 before being expelled. FIG. 4 illustrates a projection 5*a* which is arranged perpendicular to the rotor shaft. By this configuration air hits the projection 5*a*, and generation of air swirls is thereby restricted. FIG. 5 illustrates a projection 5*b* which is arranged parallel to the rotor shaft, the generation of swirls is also restricted by means of the projection 5*b*.

Figure 6:
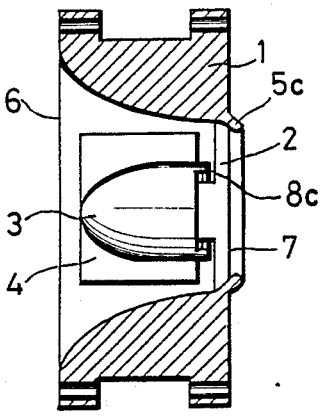
FIG. 6 is a cross-sectional view illustrating a further embodiment of projections.

FIG. 6 illustrates a projection 5*c* which is arranged at an angle with respect to the rotor shaft. The generation of swirls is also restricted by means of this type of projection.

Figure 7:
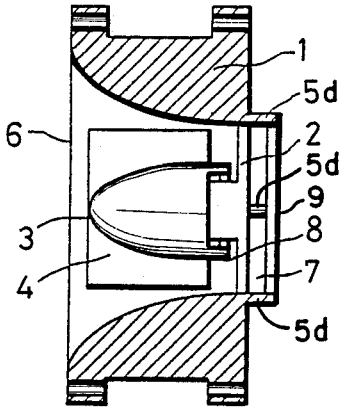
FIG. 7 is a cross-sectional view illustrating a still further embodiment of projections.

FIG. 7 illustrates a plurality of projections 5*d* which are arranged circularly around the outlet port with a ring 9 provided at the trailing tips of the projections 5*d*.

Figure 8:
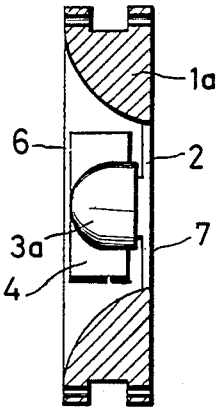
FIG. 8 is a cross-sectional view illustrating an embodiment of a casing and a hub according to the present invention.

FIG. 8 illustrates an embodiment in which the cross-sectional shapes of the case 1*a* and the hub 3*a* have the form of a quarter circle, by this configuration air can flow smoothly along the curved surfaces.

Figure 9:
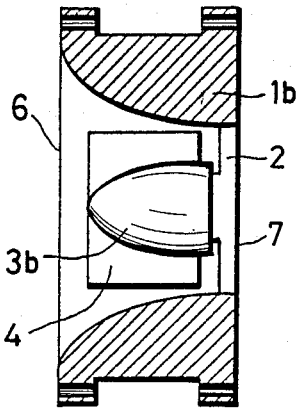
FIG. 9 is a cross-sectional view illustrating another embodiment of a casing and a hub.

FIG. 9 illustrates an embodiment in which the cross-sectional shapes of the case 1*b* and the hub 3*b* are designed in the form of ellipes, the major axis being arranged parallel to the rotor shaft, and the minor axis being arranged perpendicular to the rotor shaft.

Figure 10:
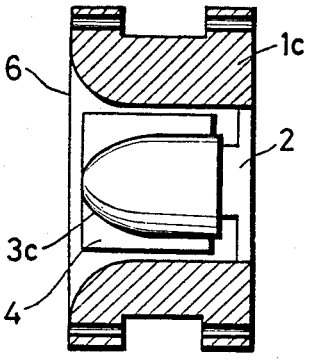
FIG. 10 is a cross-sectional view illustrating a further embodiment of a casing and a hub.

FIG. 10 illustrates an embodiment in which the inside cross-sectional shape of the casing is formed with a leading part of circular shape at the inlet port area and a trailing straight line part essentially parallel with the rotor shaft.

We claim:

1. An axial flow fan comprising: means defining a casing having spaced apart air inlet and outlet ports and having means therein defining an air flow passage communicating the inlet and outlet ports, the air flow passage having its maximum diameter at the air inlet port and its minimum diameter at the air outlet port; a rotationally driven hub rotatably disposed within the casing along the air flow passage and carrying a plurality of fan blades which extend radially outwardly from the hub; supporting means rotatably supporting the hub to undergo rotation within the casing whereby rotation of the hub causes air to flow through the air inlet port and along the air flow passage and out through the air outlet port accompanied by the formation of air swirls in the region of the air outlet port; and means disposed on at least one of the casing and hub in the region of the air outlet port for dividing the air swirls into smaller size swirls, the means for dividing the air swirls comprising a projection on the casing, the projection extending circumferentially around the air flow passage and radially inwardly into the air flow passage.

2. An axial flow fan according to claim 1; wherein the projection extends inwardly perpendicular to the axis of rotation of the hub.

3. An axial flow fan according to claim 1; wherein the means for dividing the air swirls comprises a projection on the hub, the projection extending circumferentially around the hub and radially outwardly into the air flow passage.

4. An axial flow fan according to claim 3; wherein the projection extends outwardly perpendicular to the axis of rotation of the hub.

5. An axial flow fan comprising: means defining a casing having spaced apart air inlet and outlet ports and having means therein defining an air flow passage communicating the inlet and outlet ports, the air flow passage having its maximum diameter at the air inlet port and its minimum diameter at the air outlet port; a rotationally driven hub rotatably disposed within the casing along the air flow passage and carrying a plurality of fan blades which extend radially outwardly from the hub; supporting means rotatably supporting the hub to undergo rotation within the casing whereby rotation of the hub causes air to flow through the air inlet port and along the air flow passage and out through the air outlet port accompanied by formation of air swirls in the region of the air outlet port; and means disposed on at least one of the casing and hub in the region of the air outlet port for dividing the air swirls into smaller size swirls, the means for dividing the air swirls comprising a projection on the hub, the projection extending circumferentially around the hub and radially outwardly into the air flow passage.

6. An axial flow fan according to claim 5; wherein the projection extends outwardly perpendicular to the axis of rotation of the hub.

* * * * *